US008231429B2

(12) United States Patent
Hildebrand et al.

(10) Patent No.: US 8,231,429 B2
(45) Date of Patent: Jul. 31, 2012

(54) SLOW SPEED SPINDLE FOR MICROPUNCH GRINDING

(75) Inventors: Greg A. Hildebrand, Keizer, OR (US); John Wollseiffen, Canby, OR (US); Russell Muhlestein, Keizer, OR (US)

(73) Assignee: Xerox Corporation, Norwalk, CT (US)

( * ) Notice: Subject to any disclaimer, the term of this patent is extended or adjusted under 35 U.S.C. 154(b) by 484 days.

(21) Appl. No.: 12/551,435

(22) Filed: Aug. 31, 2009

(65) Prior Publication Data

US 2011/0053459 A1 Mar. 3, 2011

(51) Int. Cl.
*B24B 49/00* (2006.01)

(52) U.S. Cl. ..... 451/6; 451/397; 451/398

(58) Field of Classification Search ..... 451/6, 11, 451/244, 246, 397, 398
See application file for complete search history.

(56) References Cited

U.S. PATENT DOCUMENTS

| | | | | | |
|---|---|---|---|---|---|
| 2,417,810 | A | * | 3/1947 | Crossman et al. | 125/30.02 |
| 2,522,485 | A | * | 9/1950 | Silven et al. | 451/221 |
| 2,610,448 | A | * | 9/1952 | Mader | 451/251 |
| 2,838,883 | A | * | 6/1958 | Hall | 451/216 |
| 3,626,644 | A | * | 12/1971 | Cupler | 451/48 |
| 3,738,063 | A | * | 6/1973 | Cupler, II | 451/143 |
| 4,417,423 | A | * | 11/1983 | Cave et al. | 451/41 |
| 5,575,708 | A | * | 11/1996 | Chau et al. | 451/305 |

* cited by examiner

*Primary Examiner* — Maurina Rachuba
(74) *Attorney, Agent, or Firm* — Marger Johnson & McCollom PC

(57) ABSTRACT

An apparatus has a motor, a shaft attached to the motor arranged to be turned by the motor when the motor operates, an attachment at an end of the shaft opposite the motor arranged to allow mounting of components to be ground, a loading block arranged under the end of the shaft having the attachment to support the components to be ground, and an interface to a grinding tool arranged adjacent to the loading block. An apparatus has a motor mounted on a slide, a shaft attached to the motor arranged to spin when the motor operates, an attachment on the end of the shaft to allow attachment of a component, a loading block at least partially supporting the shaft, an interface to a manufacturing tool, the motor and shaft arranged to insert the shaft into the interface when moved along the slide to an engaged position.

13 Claims, 5 Drawing Sheets

SLOW SPEED SPINDLE FOR MICROPUNCH GRINDING

BACKGROUND

Micropunches are used in fabrication processes to form small holes, usually in environments requiring high precision. Parts or components of systems having high precision requirements rely upon the alignment and concentricity of the holes formed by these micropunches. If the holes are misaligned or have high concentricity errors, the system using those parts may fail.

Generally, a grind process forms the tip of the micropunch using a slow speed spindle and a collet. Sources of error in the process include temperature fluctuations in the spindle oil, misalignment of the spindle body in the collet, and component wear in some of the spindle components. In addition, the current spindle construction has several components having tight tolerances. As a result, the process builds the parts for each spindle together and parts do not exchange well between spindles. Replacement of worn parts becomes complicated and generally requires manufacture using instruments accurate enough to ensure proper alignment of the replacement part.

The sources of error may result in excessive concentricity error between the outer diameter of the punch body and the outer diameter of its ground punch tip. These errors may cause the tip to form a hole that is not properly aligned and/or not truly circular in a component part of a larger system. In some systems, this issue can cause yield losses up to 30%. These losses result in more material costs for manufacture of the components requiring highly precise apertures, raising the cost of the component and in turn of the whole system. Further, the errors can lead to system failures in the overall system.

DETAILED DESCRIPTION OF THE EMBODIMENTS

Figure 1:
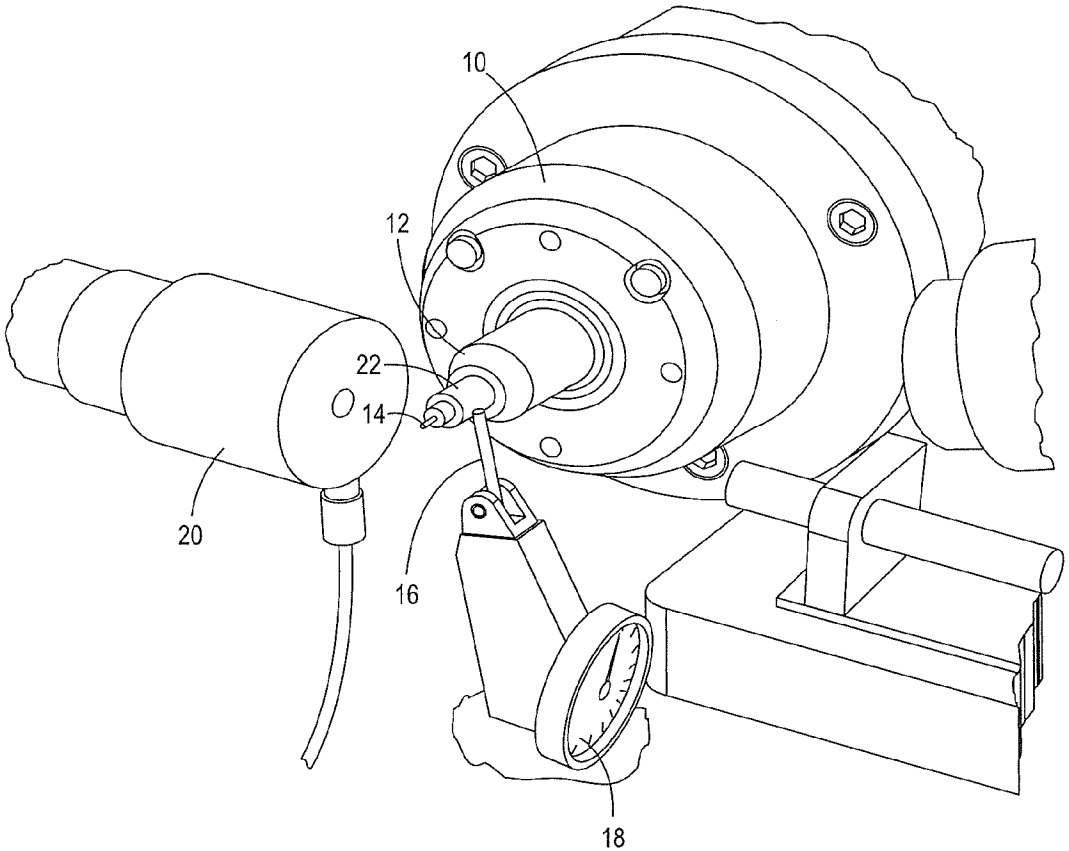
FIG. 1 Prior Art
FIG. 1 shows a micropunch mounted in a collet on a current spindle.

FIG. 1 shows an example of a spindle 10, having a collet 12 in which is mounted a micropunch 14. A dial indicator 18 touches the exposed portion of the punch body 22 extending from the collet 12 on the current spindle 10. In one embodiment, the tungsten carbide tip of the punch has a diameter of 0.015 inches prior to grind. To the left of the punch body is a high magnification lens under a lens cover 20. This allows measurements on the punch tip during the grind process. During the grind process, a vertically mounted, high speed spindle with a grind wheel is brought into contact with the micropunch 14 from above. This leads to very tight spatial constraints during the grind process, which contribute to issues with heat dissipation, the operator being able to extract the micropunch after grind without any damage, etc.

Figure 2:
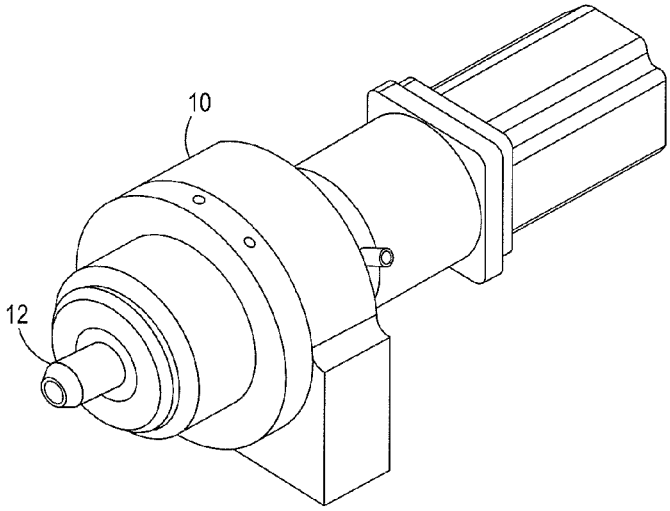
FIG. 2 Prior Art
FIG. 2 shows a current spindle.

FIG. 2 shows a current spindle such as 10 from FIG. 1. The collet 12 extends from the spindle body for holding the punch body and ultimately the micropunch tip. In this view, one cannot see the complexities of the spindle components that may lead to a cumulative error resulting in improperly manufactured micropunch tips.

Figure 3:
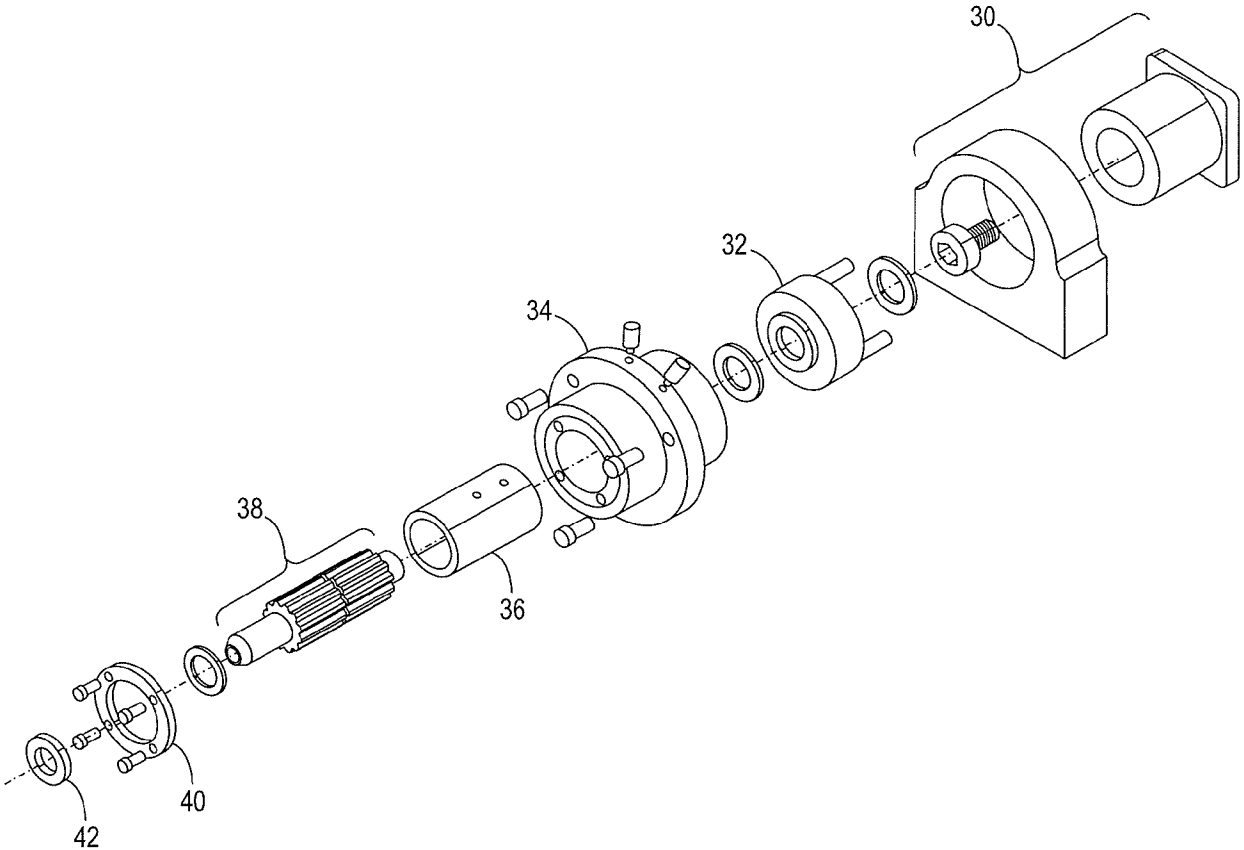
FIG. 3 Prior Art
FIG. 3 shows an exploded view of a current spindle.

FIG. 3 shows an exploded view of the spindle 10. The spindle housing 34 mates with the mounting block 30. The right end cap 32 mates with the spindle housing 34. A journal bearing 36 encases the shaft assembly 38, in turn mating to the right end cap 40 and sealed by the seal 42. The shaft assembly 38 is comprised of two journals and a shaft.

The critical interfaces in these components include the interface between the bearing 36 to the outer housing 34, the interface between the journals and the shaft in the assembly 38, the journals in assembly 38 and the bearing 36, and eventually the punch body to the shaft in the assembly 38. Each one of these interfaces gives an opportunity for tolerance stack-up or error. Further the twin journals in the assembly 38 must be identical to prevent wobble. Wear occurs on the bearing 36 where these journals spin.

The grind process generally grinds the tungsten carbide tip to a diameter in the range of 40 micrometers (μm) and a length of 250 μm. This results in the grind operation being very sensitive to vibration. The journal bearing 36 and shaft 38 allow the spindle components to float on a thin film of oil while rotating, isolating the punch from vibrations from the motor/spindle side.

The combination of the tight tolerances required to minimize errors among the components and the fluid pressure inside the hydrodynamic bearings results in a relatively large torque required to spin the bearing the required 3-5 revolutions per second. This large torque, as well as the tight spacing, generates and retains heat, affecting the film thickness of the oil in the bearing. This may result in variations in the center of rotation of the spindle, in turn affecting the center of the punch tip. Concentricity error between the cylindrical punch body and the cylinder of the ground punch tip results. In some experiments, temperatures increased up to 30 degrees Fahrenheit during one punch grind process.

In addition, metal on metal contact occurs in the hydrodynamic bearing at start up of the spindle, causing wear over time. The tight tolerances in the spindle components have led to the parts being manufactured together for each spindle, making exchanging parts between spindles difficult. Replacing worn components requires machining in an environment having adequate instrumentation for measurement to ensure proper alignment of the parts.

Another source of error lies in the presence of the high magnification lens in close proximity of the punch tip during grind, limiting the space allowed for a spindle or collet system. Currently, this has resulted in a collet of a precision-ground bore, using vacuum and compressed air to hold and extract the punch body. The tightness of this fit restricts the bore to a close running fit, to allow for minor variations in punch body diameters and to ensure the operator can install/uninstall the punch without significant time or effort. Experiments found that clearances less than 0.0001 inches failed because the punch tips could not be extracted without rubber gripped pliers and a high risk of breaking the fragile punch tip. The combination of the large bore clearance and the small variations in punch body diameters causes fit problems between the parts. This problem results in geometry errors in the punch tip.

Another limitation in this type of collet lies in the fact that some portion of the punch tip must remain outside the bore to allow the operator to grab the part before being extracted with compressed air. Otherwise, a strong possibility exists that the punch will be fired into the operator's hands or fingers. The dial indicator in FIG. 1 measures the end of the punch body extending from the collet for run-out, an error due to misalignment with the bore. The error may range from 0.5 mil to approximately 2 mil.

Once ground, the punches enter into the manufacture process for whatever components require highly precise holes. In one example, the punch is slid into a precision ground and hardened tube as part of the hole-forming machine tooling. Some punches experience fit problems with the tooling, resulting in immediate rejection or premature failure. These fit problems are very difficult to catch in the upstream grind process, as the grind process itself does not sense the problem in the fit of the punch to the collet.

Figure 4:
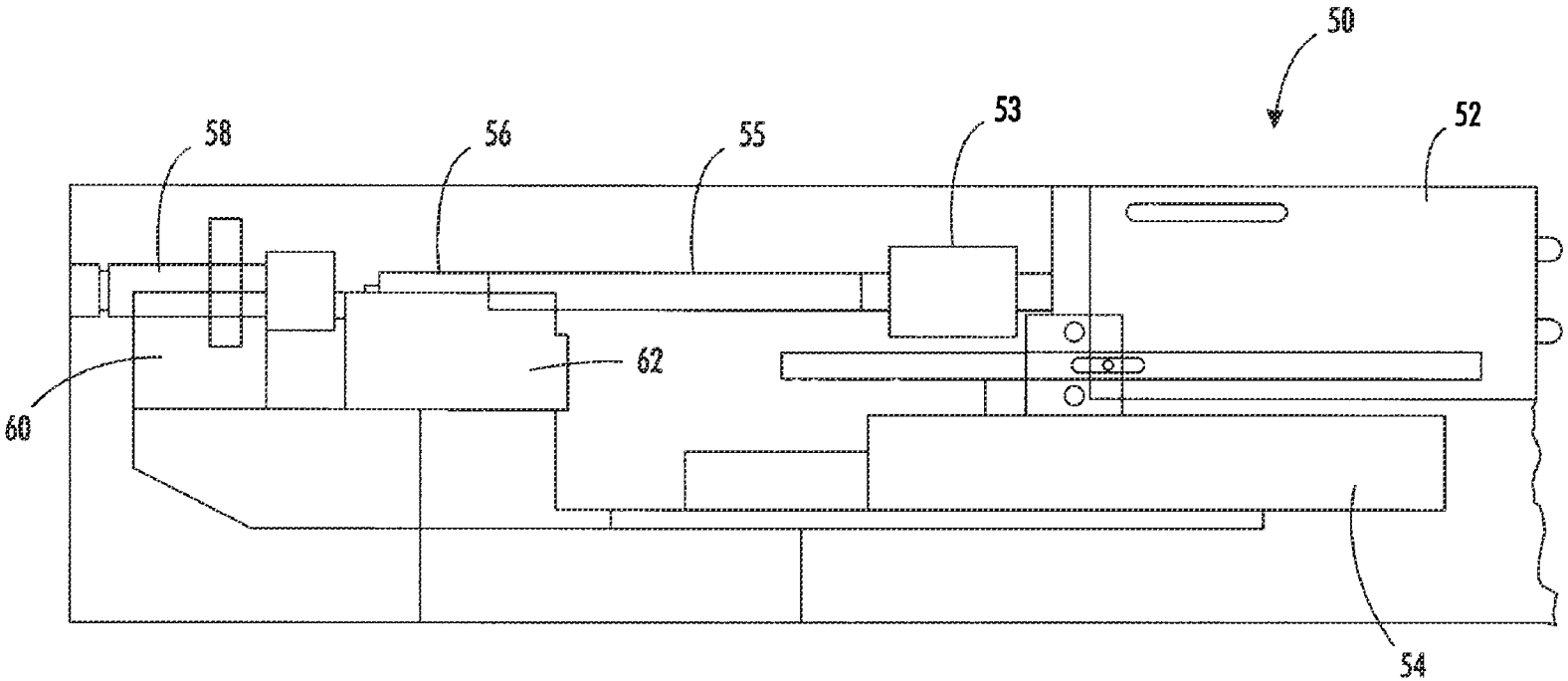
FIG. 4 shows an embodiment of a spindle design.

FIG. 4 shows a new spindle design that eliminates or mitigates most of these issues. The apparatus 50 has a motor 52, mounted on some sort of mechanism that allows the motor to move 54. Examples include a linear slide or shaft. The motor couples to a shaft 55 through a coupling 53. In the case of the micropunch grinding process set out above, the micropunch body 56 would attach to the end of the shaft for the grinding process. This attachment may include a t-slot, a threading into which the body could be screwed, a chuck or any other type of attachment that mates the component to be ground to the shaft 55. The mating or loading would occur on the loading block 62 that supports the shaft at least partially.

Once the component to be ground or otherwise machined is mounted to the shaft, the motor would slide towards the interface to the manufacturing machinery, in this case a tube that presents the micropunch to the grinding tool. This motion would then cause the micropunch body to slide into the tube 58, mounted on the mounting block 60 such that the component would extend past the tube to be ground by the grinding tool.

One should note that this particular apparatus allows micropunches to be ground with much higher precision than previous systems. However, no limitation exists, nor should any be implied to grinding processes or tooling. Further, while the interface to the manufacturing tool here consists of a tube, no such restriction exists nor should it be implied. The discussions of FIGS. 4 and 5 reference those structures specific to the grinding process, but the structures disclosed here may apply to any type of component mounting system for machining or other manufacture.

Figure 5:
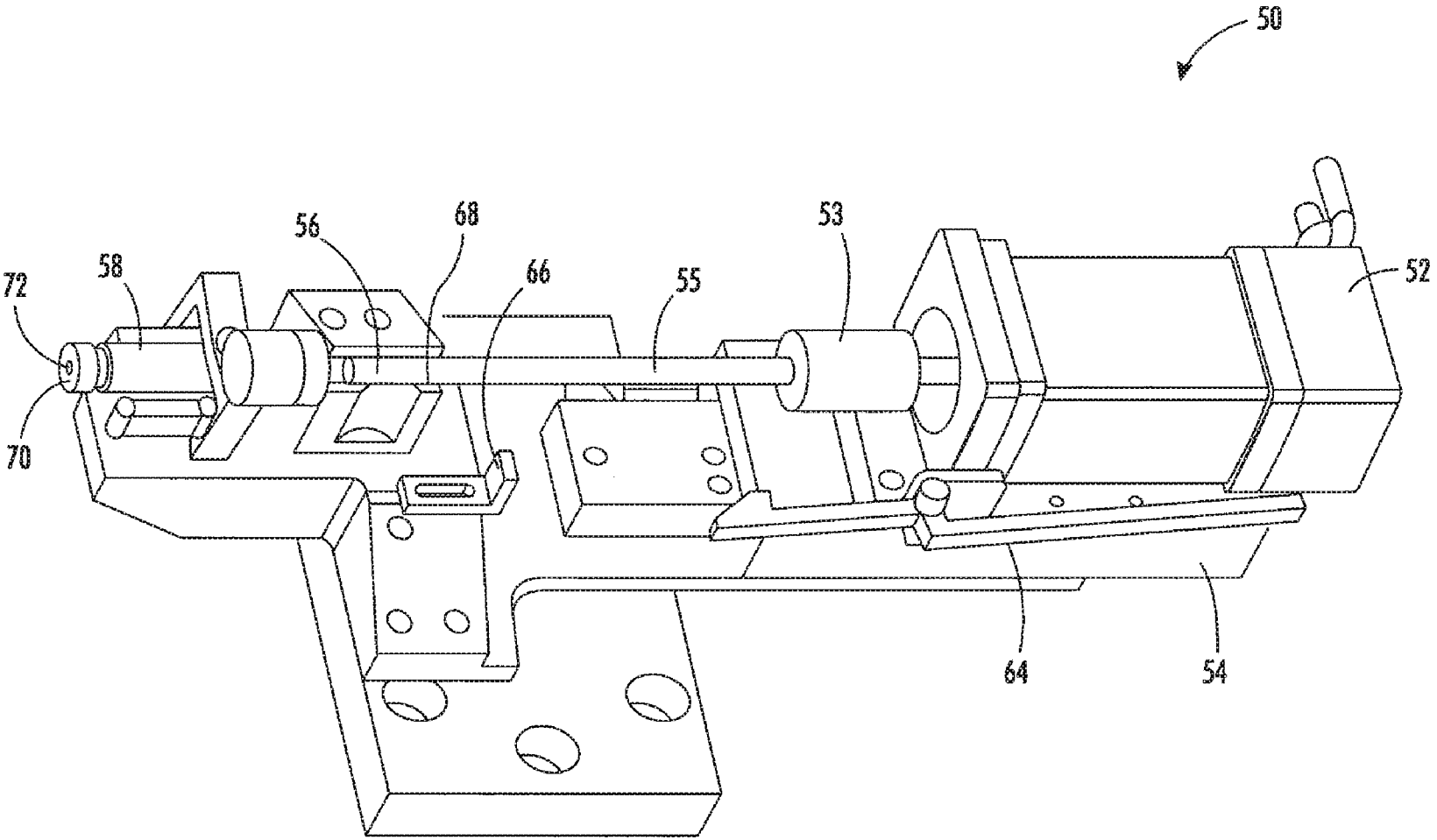
FIG. 5 shows another view of an embodiment of a spindle design.

FIG. 5 shows another view of a spindle apparatus 50. The motor 52 mounts onto a linear slide 54. Once the component to be machined, such a micropunch 56, is attached to the shaft 55 by an attachment, in this case t-slot adapter 68, the motor slides forward to slide the component through the manufacturing tool interface 58. In this instance the interface 58 consists of a tube, having a threaded end cap 70 with a hole 72. The hole 72 allows the micropunch tip to extend past the end of the tube. When the motor slides forward towards the interface, a latch mechanism such as 64 latches to bracket 66, holding the motor in its engaged position.

In the example of the micropunch, this arrangement has several advantages. Nominal clearance between the punch body and the tube in one embodiment was 0.00004 inches. Further, the ability to load the punch into the tube from the back removes the need to manipulate the punch in the space by the camera at the other end as shown in FIG. 1.

The punch body attaches to the shaft, such as by way of the t-slot shown in FIG. 5, providing the operator with much more leverage in inserting the punch. Additionally, the operator has instant feedback and can feel how well the punch fits, addressing problems with the fit before the punch undergoes grinding. This eliminates some of the waste associated with previous processes.

An advantage of this approach lies in its use of previously existing components, either from the tooling used in the manufacturing or from the previous spindle design. For example, the interface to the tooling in this case consists of the grinding tool tube, which can provide a bearing with a near perfect fit for the punch body. Further, the tube can undergo some minor grinding allowing it to locate easily in the mounting block 60 of FIG. 4. The same motor and servo coupler from the previous spindle design work in the new design as well, allowing retrofitting of the already owned motors.

During operation, the operator drops oil onto the punch body before insertion into the tube, providing an adequate oil film for the duration of the grind process. Experiments have shown that temperature in the tube increased less than 2 degrees F. during multiple operations.

The threaded cap 70 in FIG. 5, also a component from the manufacturing tooling, has a modification of a bronze bearing or washer and a through hole for the tip of the punch. The latch mechanism holds the motor in place with enough force to hold the punch against this washer. This results in the smaller diameter tip and the shaft to extend out of the cap. Slight variations in the punch body diameter become much less of a factor because the entire punch body resides inside the tube, which acts as a bearing.

In terms of the previous issues, this new design removes many of these issues. The new spindle still consists a hydrodynamic bearing, with the shaft riding on a pressurized film of oil, still providing adequate vibration isolation. In experiments, over 1600 punches underwent grinding with no measurable change in the breakage rate or the visible quality surface.

This design replaces the relatively massive journal bearing, custom manufactured out of at least 9 machined components, with just two components weighing less than 1 pound. The heat generation has all but ceased to exist, with the oil temperature increase dropping from 30 degrees to approximately 1 degree F.

The ability to rear-load the punch provides the opportunity to drop oil directly on it prior to insertion, eliminating any metal on metal wear during start up. In these conditions, the precision ground and hardened tube and punch bodies will last much longer. The tubes have high availability as they can even come from the tooling tubes for the manufacturing machinery.

The rear-loading also provides many other benefits. It prevents accidental bumping of the lens/camera experienced during loading and unloading in the previous design. This required recalibration and affected yield. The operator has much more room and leverage during loading, including a punch keyed to a shaft that can rotate as necessary during loading. The clearance between the punch and the tube can remain very small due to the leverage. Unloading becomes very simple, with the operator merely sliding back the motor and exposing the finished part, reducing any opportunities to break the punch. The punch body resides completely inside the tube, reducing impact from diameter variation in the punch body, reducing the concentricity error to the difference between the punch body and the tube, around 0.00004 inches. Finally, the operator will feel any resistance or potential fit issues before grinding, allowing correction at that time, preventing any waste of the punches.

As mentioned above, upstream issues exist of the punch being manufactured without any exposure to the ultimate tooling into which the punch will be inserted when deployed in manufacturing. By using in the grinding process the actual component from the tooling in which the punch will ultimately be used, any issues will be detected before the punch is ground. The interface to the tooling for the grinding process above may consist of a tube from the machine in which the punch will be deployed to form holes. This eliminates any downstream issues of using the punch after grinding to form holes or apertures in the final product.

In experiments, the grind yield data was as follows. In the previous spindle design, a 32% yield loss existed, with a grind concentricity process capability (Cpk) of 0.16 and a mean punch error passed into the manufacturing process of the final system of 0.0004 inches. In the new spindle design, 0% yield loss exists, with the grind concentricity process capability (Cpk) of 2.07 and the mean punch error below the current measurement capability of 0.00005 inches.

It will be appreciated that several of the above-disclosed and other features and functions, or alternatives thereof, may be desirably combined into many other different systems or applications. Also that various presently unforeseen or unanticipated alternatives, modifications, variations, or improvements therein may be subsequently made by those skilled in the art which are also intended to be encompassed by the following claims.

What is claimed is:

1. An apparatus, comprising a motor;

a shaft attached to the motor arranged to be turned by the motor when the motor operates;

an attachment at an end of the shaft opposite the motor arranged to allow mounting of components to be ground;

a loading block arranged under the end of the shaft having the attachment to support the components to be ground; and an interface to a grinding tool arranged adjacent to the loading block.

2. The apparatus of claim 1, wherein the motor is mounted on a linear slide.

3. The apparatus of claim 2, wherein the slide is arranged to allow the component to be ground to be introduced into the grinding tool through the interface by sliding the motor.

4. The apparatus of claim 2, further comprising a latch arranged to hold the motor in place after the motor has been moved along the slide.

5. The apparatus of claim 1, wherein the attachment further comprises a threading or t-slot to allow attachment of the component to be ground.

6. The apparatus of claim 1, wherein the interface to the grinding tool comprises a tube.

7. The apparatus of claim 6, the tube including a cap having a washer and a through hole to allow the component to be ground to extend out of the tube.

8. An apparatus, comprising:

a motor mounted on a slide;

a shaft attached to the motor arranged to spin when the motor operates;

an attachment on the end of the shaft to allow attachment of a component;

a loading block at least partially supporting the shaft;

an interface to a manufacturing tool, the motor and shaft arranged to insert the shaft into the interface when moved along the slide to an engaged position.

9. The apparatus of claim 8, further comprising a latching mechanism arranged to hold the motor in place at the engaged position.

10. The apparatus of claim 8, wherein the attachment comprises a t-slot, a threading or a chuck.

11. The apparatus of claim 8, wherein the interface comprises a tube.

12. The apparatus of claim 9, wherein the manufacturing tool comprises a grinding tool.

13. The apparatus of claim 8, further including a camera mounted a side of the interface opposite a side having the motor and shaft.

* * * * *